US010292489B2

(12) United States Patent
Storiko

(10) Patent No.: US 10,292,489 B2
(45) Date of Patent: May 21, 2019

(54) TABLE

(71) Applicant: Wilkhahn Wilkening + Hahne GmbH + Co. KG, Bad Münder (DE)

(72) Inventor: Andreas Storiko, Grünwald (DE)

(73) Assignee: WILKHAHN WILKENING + HAHNE GMBH + CO. KG, Bad Munder (DE)

( * ) Notice: Subject to any disclaimer, the term of this patent is extended or adjusted under 35 U.S.C. 154(b) by 0 days.

(21) Appl. No.: 15/689,315

(22) Filed: Aug. 29, 2017

(65) Prior Publication Data

US 2018/0055213 A1 Mar. 1, 2018

(30) Foreign Application Priority Data

Aug. 31, 2016 (DE) ..... 10 2016 116 232

(51) Int. Cl.
*A47B 3/00* (2006.01)
*A47B 3/091* (2006.01)
*A47B 3/08* (2006.01)

(52) U.S. Cl.
CPC ..... *A47B 3/0911* (2013.01); *A47B 3/0815* (2013.01); *A47B 3/0918* (2013.01)

(58) Field of Classification Search
CPC ..... A47B 3/0815; A47B 3/0818; A47B 3/091; A47B 3/0918
See application file for complete search history.

(56) References Cited

U.S. PATENT DOCUMENTS 6,374,756 B1 * 4/2002 Fieldwick ..... A47B 3/0918 108/131
2003/0167980 A1 * 9/2003 Suzuki ..... A47B 3/0815 108/129
2006/0021552 A1 * 2/2006 Pleiman ..... A47B 3/0918 108/132
2009/0078174 A1 * 3/2009 Larcom ..... A47B 3/0815 108/169

(Continued)

FOREIGN PATENT DOCUMENTS

DE 7819229 U1 10/1978
DE 3916347 A1 8/1990

*Primary Examiner* — Matthew W Ing
(74) *Attorney, Agent, or Firm* — Renner Kenner Greive Bobak Taylor & Weber

(57) ABSTRACT

A table has at least one table leg and a table top, the at least one table leg being pivotable relative to the table top, between an unfolded position and a folded position, about at least one first joint, wherein a strut is held on the table leg so that, at a first end, it is pivotable about a second joint, is provided for fixation of the table leg, and in the unfolded position of the table leg, it is operatively connected to the table top at a second end, opposite the first end. The table leg has a stop limiting the angle between the table leg and the table top in the unfolded position, such that the strut comes into frictional contact with the second end on a support surface held on the table top. In an unfolded direction of the strut, the support surface extends from a first end to a second end, and the distance from the first end of the support surface to the second joint in the unfolded position of the table leg is greater than the distance from the second end of the support surface to the second joint in the unfolded position of the table leg, so that, in the unfolded position, the strut is in self-locking frictional contact with the support surface.

12 Claims, 7 Drawing Sheets

(56) References Cited

U.S. PATENT DOCUMENTS

2015/0272315 A1* 10/2015 Merey ..... A47B 3/0918
108/50.02
2016/0206088 A1* 7/2016 Illulian ..... A47B 3/06

* cited by examiner

TABLE

TECHNICAL FIELD

The invention relates to a table having at least one leg and a table top, wherein the at least one table leg is supported, so that it can pivot about a first joint between an unfolded position and a folded position.

BACKGROUND

Such folding tables can be folded up in a very short amount of time and stored in a space-saving manner. To secure the table leg in the folded position, usually a support, which is held on the table leg so that it can be pivoted about a joint at a first end, and in the unfolded position of the table leg is secured on the table top with a second end opposite the first end. The connection between the strut and the table top is usually sufficiently stable, but it often has a slight play, so that some wobbling of the table in the upright position cannot be completely prevented. To secure the struts on the table top in the unfolded condition of the table leg, for example, a snap closure is provided that must be opened in order to fold up the table. However, this often results in jamming, which prevents the table from being folded up.

DE 39 16 347 A1 describes a folding table with a table top and hinged legs, wherein a strip-shaped anchoring element is connected by hinge to the legs, whose free ends are designed so that the legs can be locked in place by inserting the free ends into fittings beneath the table top to create a friction-locking connection.

DE 39 16 347 A1 describes a folding table having a fastening device on a vertical component, wherein, when unfolding the table top, a supporting strut is automatically lockable on a latching device on the underside of the table top, and the latching device is releasable by means of a hand lever.

SUMMARY

The object of the present invention is therefore to provide a table, which is characterized by particularly simple handling in folding and unfolding of the table legs and which represents a very rigid construction when unfolded.

According to the invention this object is achieved by the features of claim 1.

The table according to the invention has at least one leg and a table top, the at least one table leg being held so that it can be pivoted, relative to the table top, about at least one first joint, between an unfolded position and a folded position, wherein a strut, which is held so that, at a first end, it can be pivoted about a second joint on the table leg, is provided for securing the table leg in the unfolded position, and at a second end that is opposite the first end, the strut is operatively connected to the table top in the unfolded position of the table leg, and the table leg has a stop, which limits the angle between the table leg and the table top in the unfolded position of the table leg, wherein, in the unfolded position of the table leg, the strut comes into frictional contact with the second end on a support surface that is held on the table top. The support surface extends from a first end to a second end in an unfolded direction of the strut, and the distance between the first end of the support surface and the second joint is greater in the unfolded position of the table leg than the distance between the second end of the support surface and the second joint in the unfolded position of the table leg, so that, in the unfolded position of the table leg, the strut is in self-locking frictional contact with the support surface.

The self-locking frictional contact permits a method of fixation of the strut that is easy to implement without additional securing elements, such as snap closures or the like, without having to activate them. Self-locking frictional contact also permits a very stable and means of holding the table legs in the unfolded condition without any play.

Additional embodiments of the invention are the subject matter of the dependent claims.

In the unfolded position of the table, i.e., the table legs, the angle $\alpha$ between the table leg and the table top amounts to $90° \leq \alpha \leq 100°$, preferably 90°. In addition, at least one spring element, in particular a spiral spring, may be provided between the table leg and the strut, applying a force against the strut, pushing it into a position in which it is unfolded from the table leg. In this way, the strut automatically snaps into self-locking frictional contact when the table legs are unfolded, and together with the stop, which limits the angle between the table leg and the table top in the unfolded position of the table leg, it forms an extremely stable means of fixation of the table legs on the table top without any play.

The support surface may optionally be designed to be curved or flat.

For folding up the table legs, the strut is first folded against the force of the spring element until it is behind the first end of the support surface in the direction of the table leg, so that the table leg is released and can also be folded up. Therefore, a sliding surface or step may be connected to the support surface in the direction of folding of the strut, wherein the strut comes into sliding contact (i.e., non-self-locking contact) with the sliding surface or step in at least some phases when folding up the table leg.

According to a preferred embodiment of the invention, the support surface is aligned with respect to the strut, so that in the unfolded position of the table leg, the strut is in self-locking frictional contact at the contact point of the support surface, wherein the angle of the strut to the support surface at the contact point amounts to 90°±7°, preferably 90°±5°. This yields optimal self-locking frictional contact between the strut and the support surface.

In order for the strut not to be folded back up inadvertently after the table has been unfolded and set up, which would cause the table to lose its stability, a releasable locking element is provided, securing the strut in the unfolded position. The locking element is preferably formed by a pendulum, which is freely pivotable as a function of the alignment of the table between a released position, in which the strut is released, and a locked position, in which the strut is secured, depending on the alignment of the table. In addition, it is possible to provide that the pendulum cooperates with a rib arranged on the table leg when the table has been set up and the strut is unfolded, thereby having a blocking effect (locked position) and is pivoted into a released position when the table is tilted on its side. The locking element thus functions without manual locking or unlocking.

BRIEF DESCRIPTION OF THE DRAWINGS

Additional embodiments of the invention are now explained in greater detail on the basis of the following description of an exemplary embodiment and the drawing.

In the drawings.

DETAILED DESCRIPTION

Figure 1:
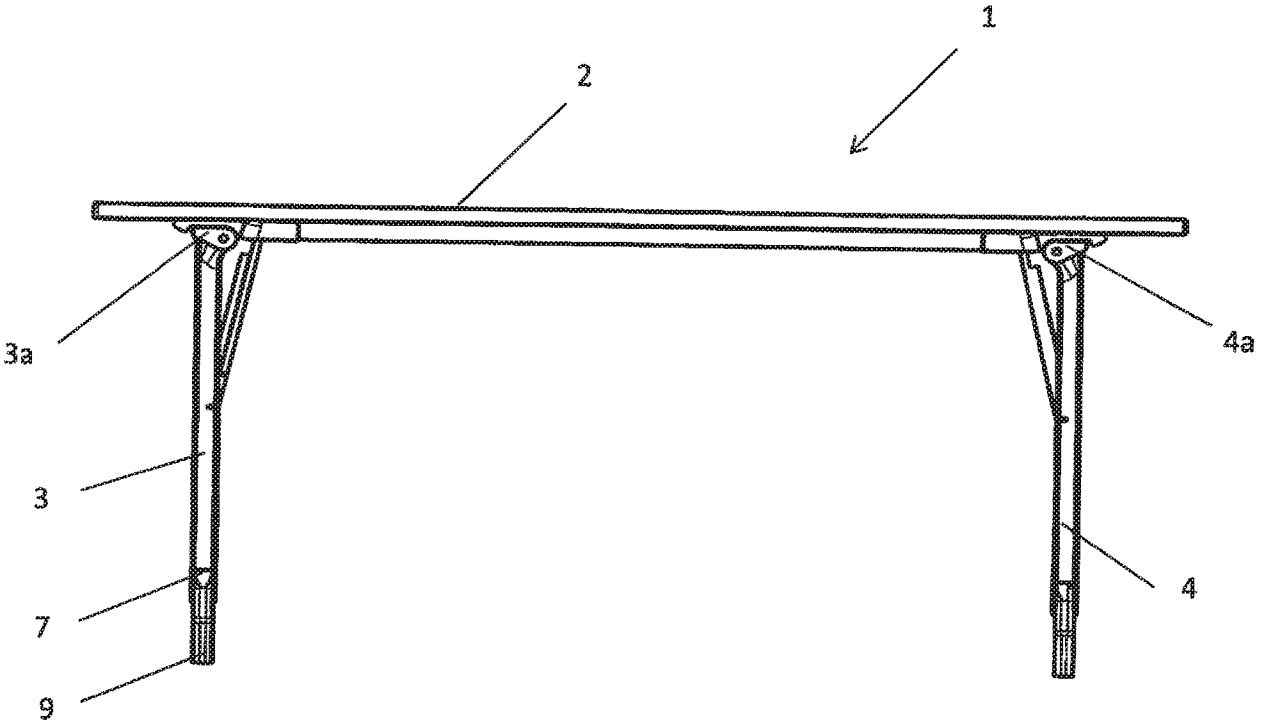
FIG. 1 shows a front view of the table according to the invention.
Figure 2:
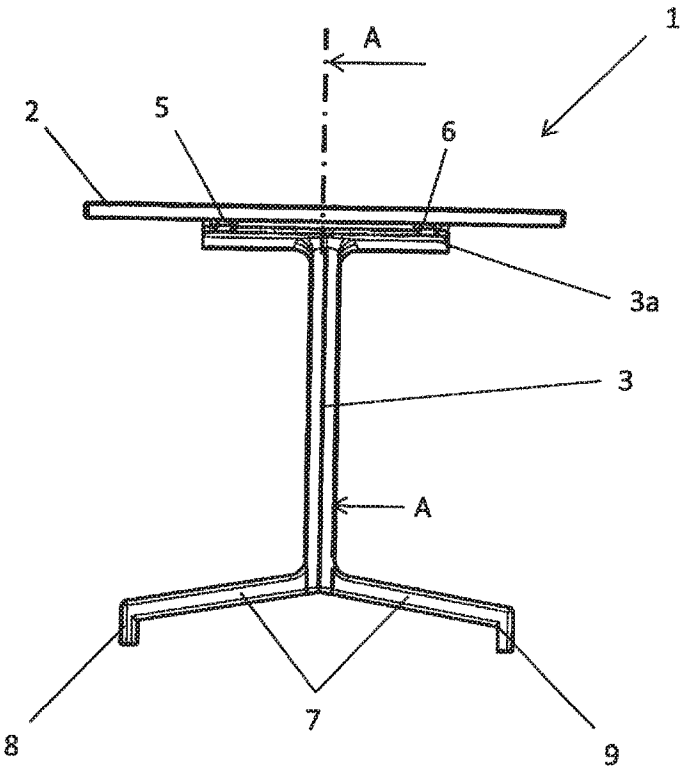
FIG. 2 shows a side view of the table according to FIG. 1.

The table 1 illustrated in FIGS. 1 and 2 is a folding table with a table top 2 and two table legs 3, 4. In the connecting region with the table top 2, each table leg 3, 4 has a crossbar 3*a* and/or 4*a*, such that each table leg 3, 4 is supported on the table top in such a way that it can pivot by means of two first joints 5, 6 at a distance from one another. The two table legs 3, 4 are each formed as a central mounting stand and have a diagonal foot bar 7 with feet 8, 9 in the lower region.

The two table legs 3, 4 are designed to be identical, so that the remainder of the description refers only to table leg 3, although it logically also applies to table leg 4.

Figure 3:
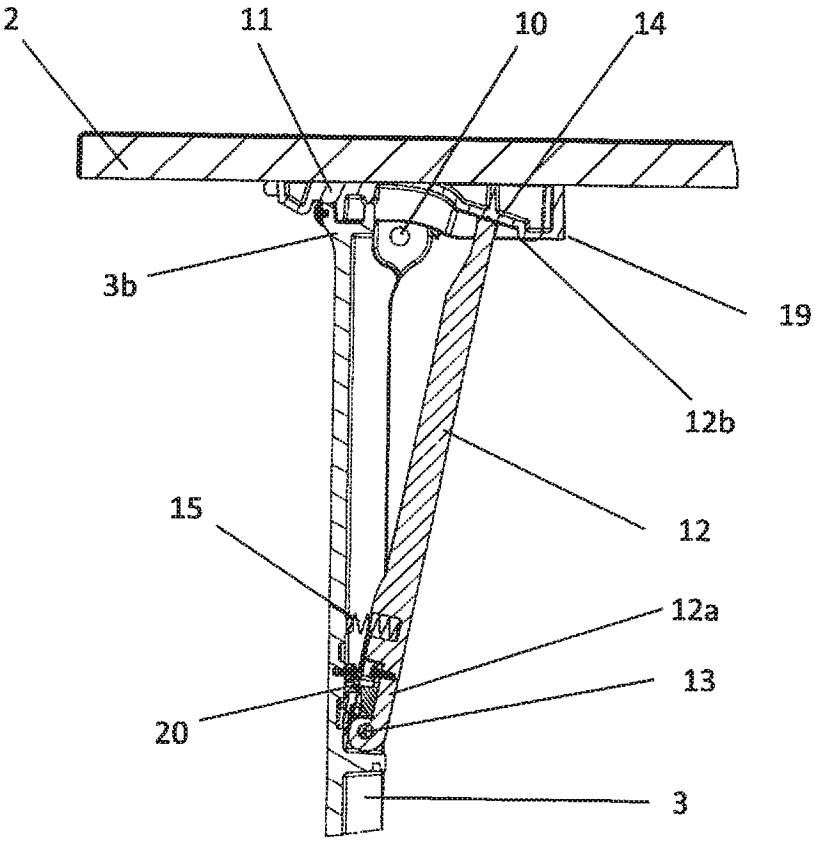
FIG. 3 shows a detail view in the region of the strut with the table leg unfolded.
Figure 4:
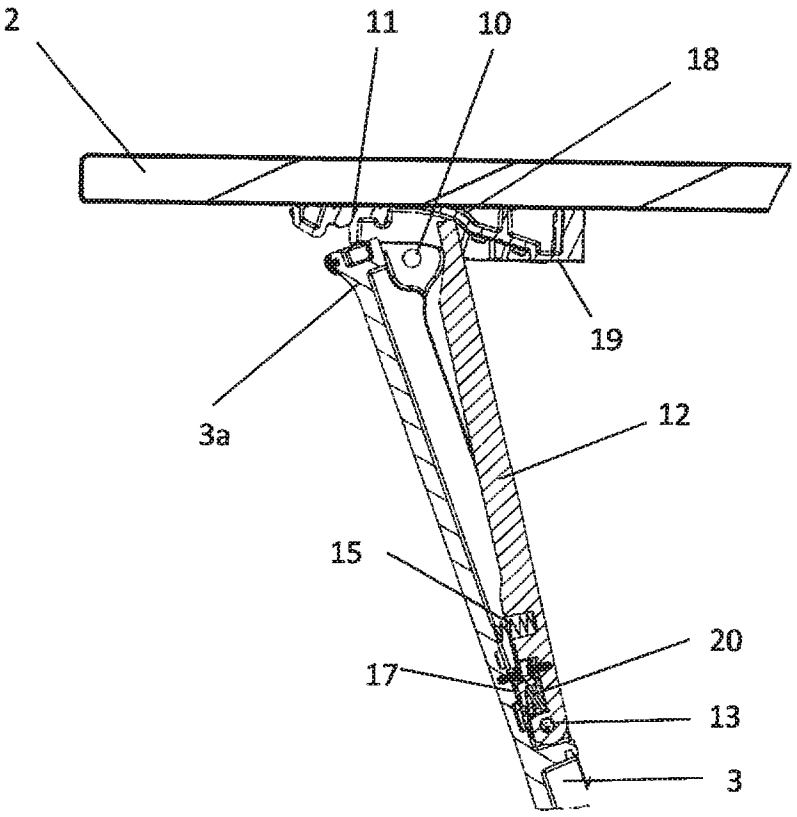
FIG. 4 shows a detail view in the region of the strut during the folding and unfolding of the table leg.
Figure 5:
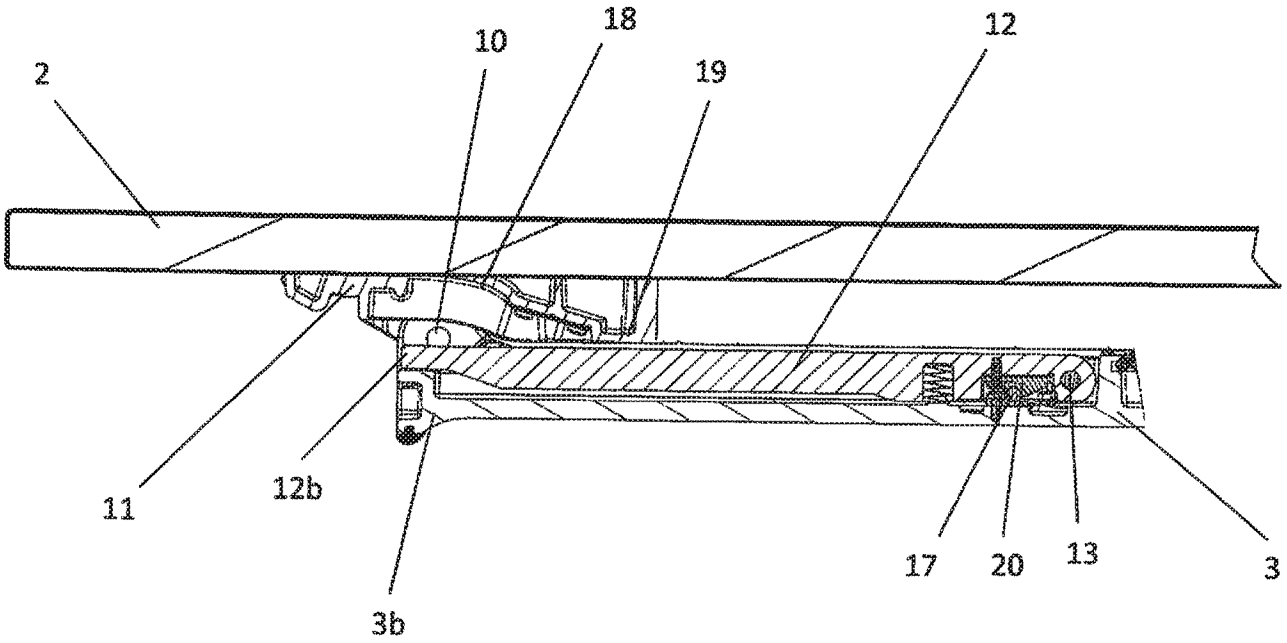
FIG. 5 shows a detail view in the region of the strut in the folded condition of the table leg.

FIGS. 3 to 5 show sectional diagrams along the line A-A in various folding positions of the table leg 3 with regard to the table top 2. The pivoting movement of the table leg takes place about a pivot axis 10, which is defined by the first joints 5, 6.

In the unfolded position of the table leg 3 according to FIG. 3, an upper end 3*b* of the table leg 3 comes in contact with a stop 11, which is attached to the table top and limits the pivoting movement of the table leg 3 about the pivot axis. In this unfolded position, the table top 2 and the table leg 3 are aligned so they are essentially perpendicular to one another.

Figure 6:
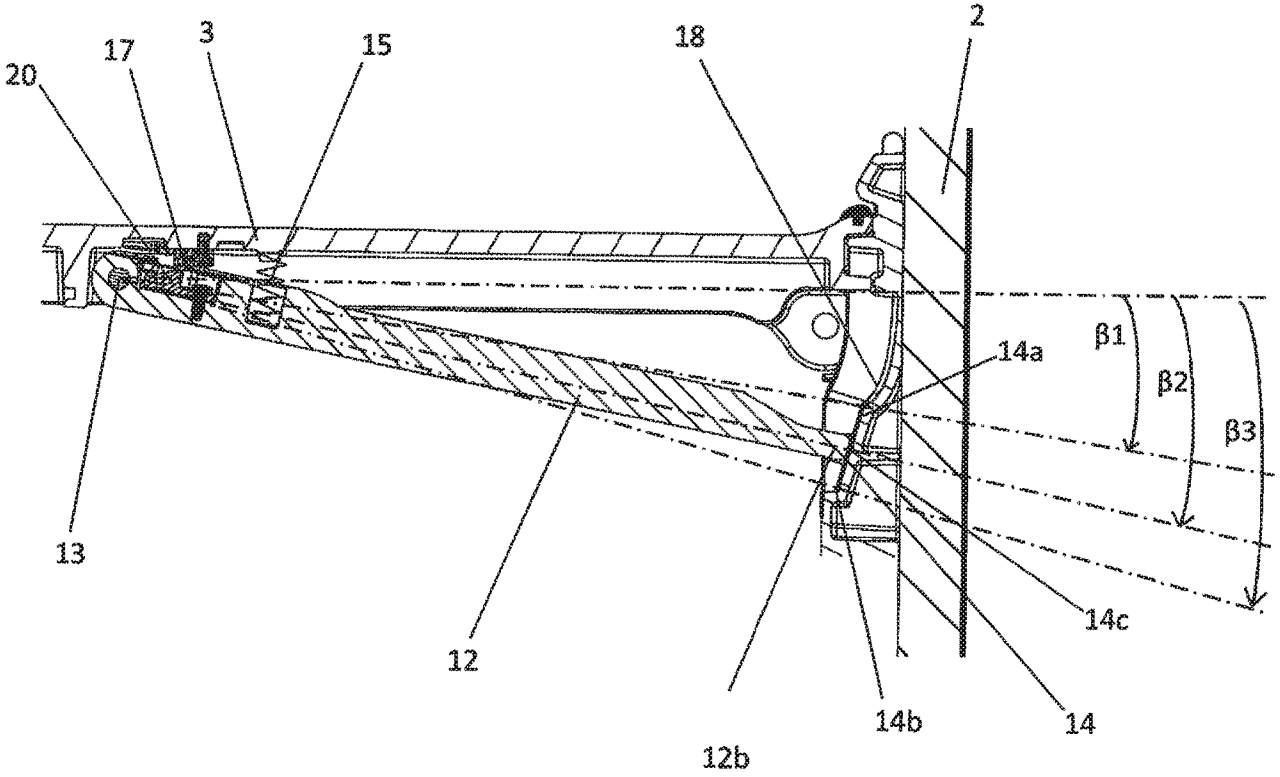
FIG. 6 shows an enlarged detail view according to FIG. 3.

To secure the table legs 3 in the unfolded position, a strut 12 is provided and is held at a first end 12*a* on the table leg 3, so that it can be pivoted about a second joint 13. The strut 12 here can be pivoted between an unfolded position according to FIG. 3 and an unfolded position on the table leg 3 according to FIG. 5, so that it can be pivoted about the second joint 13. The second end 12*b* of the strut 12 opposite the first end 12*a* comes into self-locking frictional contact with a support surface 14 mounted on the table top 2 in the unfolded position according to FIG. 3. FIG. 6 sows an enlarged diagram in this region.

At least one spring element 15 is provided between the table leg 3 and the strut 12, forcing the strut 12 into a position in which it is unfolded from the table leg 3. However, the spring element could also be designed as a torsion spring in the second joint 13.

In unfolding the table leg 3 from the position illustrated in FIG. 5 into the position according to FIG. 3, the strut 12 is thus automatically unfolded by the spring element 15 and snaps back into the position shown in FIGS. 3 through 6 after an intermediate position according to FIG. 4, so that in this new position, the second end 12*b* of the strut 12 comes into self-locking frictional contact with the support surface 14. The strut 12 is thus pivotable about the second joint 13 between a partially folded position on the table leg 3 and an unfolded position, in which the strut 12 is in self-locking frictional contact, such that, in the unfolded position of the table leg, the support surface 14 extends from a first unfolded angle β1 (for example, in the range of 9°) to a second unfolded angle βe (for example, in the range of 16°) of the strut 12 (see FIG. 6). However, the strut 12 comes into self-locking frictional contact before the end of the support surface 14, for example, at an unfolded angle β2 of 12.5°. The angle of the strut 12 to the support surface 14 amounts to approx. 7° at the unfolded angle β1, approx. 5° at the unfolded angle β2 and approx. 0° at the unfolded angle β3. Each angle is thus understood to include a tolerance range of ±1.5°, preferably ±1°.

The support surface 14 is designed to be flat in the exemplary embodiment shown here but could also have a curved shape. It extends from at least a first end 14*a* to a second end 14*b*. The self-locking frictional contact comes about at a contact point 14*c* on the support surface. The distance from the first end 14*a* of the support surface 14 to the second joint 13 in the unfolded position of the table leg is greater than the distance from the second end 14*b* to the second joint 13. The length of the strut 12 is also somewhat shorter than the distance from the first end 14*a* to the second joint 13, so that the self-locking frictional contact occurs only at the unfolded angle β2. In the position according to FIG. 3, the strut 12 forms a static triangle with the table leg 3 and the table top 2 and is aligned approximately at a right angle to the support surface 14, thereby ensuring the self-locking frictional contact. Due to the spring element 15, there is contact between the strut 12 and the support surface 14 without any play, thus resulting in an absolutely rigid construction of the table after it has been set up.

In the folding direction of the strut 12, a sliding surface 18, which is connected to the support surface 14, comes into contact with the second end 12*b* of the strut 12 in folding and unfolding the table leg (FIG. 4). For folding the table leg, first the strut 12 is folded until the unfolded angle of the strut 12 is less than β1. Then the second end 12*b* of the strut is free and the table leg 3 can be folded in. In further folding of the table leg, the strut 12 must not be held any longer but instead must come in sliding contact (i.e., non-self-locking contact) with the sliding surface 18 in at least some phase, so that in the wake of the folding of the table leg, there is a synchronous folding of the strut 12. However, to do so, the sliding surface 18 need not cause the entire folding movement of the strut 12. In the exemplary embodiment shown here, the strut 12 comes in contact with a protrusion 19 in the remaining course of folding the table leg 3, this protrusion concluding the folding movement of the strut 12 on the table leg 3 (FIG. 5).

When unfolding the table leg 3 from the position shown in FIG. 5, one must only unfold the table leg into the position according to FIG. 3. The strut 12 automatically snaps into the self-locking frictional contact at the contact point 14*c* of the support surface 14, actuated by the spring element 15.

Figure 8:
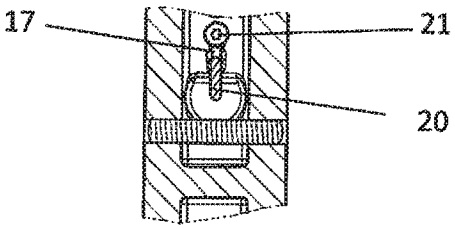
FIG. 8 shows a sectional diagram in the region of the detail X in FIG. 7, which shows the locking element in the locked position.
Figure 9:
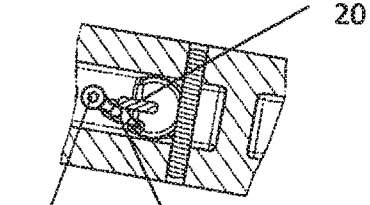
FIG. 9 shows a sectional diagram in the region of the detail X in FIG. 7, which shows the locking element in the released position.
Figure 7:
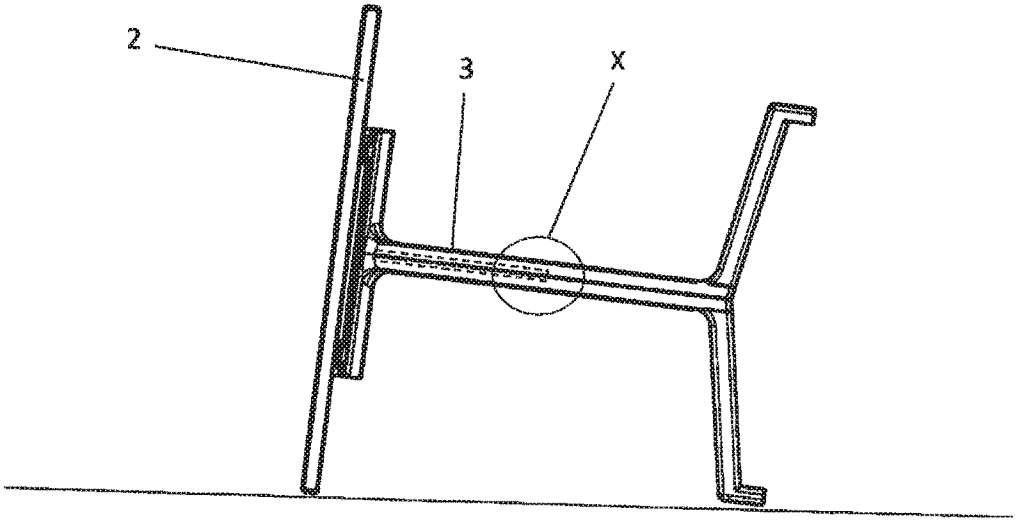
FIG. 7 shows a side view of the table tilted onto its side.

In the exemplary embodiment shown here, a locking element 17 that is provided is designed as a pendulum, which can be pivoted about a pivot axis 21, to prevent inadvertent folding of the strut 12, in the condition in which the table has been set up. When the table has been set up according to FIGS. 3 and 8, the pendulum is in a locked position, in which it cooperates with a rib 20 on the table leg, so that the strut 12 can no longer be folded by hand. As soon as the table is turned on its side, as illustrated in FIG. 7, the pendulum pivots out of the locked position according to FIG. 8 and into the released position illustrated in FIG. 9, in which the pendulum no longer cooperates with the rib 20 and therefore the strut 12 can be folded again. However, as an alternative to a pendulum, some other locking element 17, such as a ball that cooperates with a skewed plane, may also be used.

The invention claimed is:

1. A table having at least one table leg and a table top, wherein the at least one table leg is held so that it is pivotable relative to the table top about at least one first joint between an unfolded position and a folded position, wherein a strut, which is held on the table leg, so that it is pivotable about a second joint at a first end, is provided for fixation of the table leg, and in the unfolded position of the table leg, it is in operative connection with the table top at a second end, which is opposite the first end, and the table leg has a stop, which limits the angle between the table leg and the table top in the unfolded position of the table leg, such that the strut in the unfolded position of the table leg comes into frictional contact with the second end on a support surface held on the table top, wherein in an unfolded direction of the strut, the support surface extends from a first end to a second end, and the distance from the first end of the support surface to the second joint in the unfolded position of the table leg is greater than the distance from the second end of the support surface to the second joint in the unfolded position of the table leg, so that, in the unfolded position of the table leg, the strut is in self-locking frictional contact with the support surface and wherein the support surface has a contact point between the first end and the second end of the support surface, on which the strut is in self-locking frictional contact at its second end in the unfolded position of the table leg.

2. The table according to claim 1, wherein in the unfolded position of the table leg, the angle ($\alpha$) between the table leg and the table top amounts to $90° \leq \alpha \leq 100°$.

3. The table according to claim 1, wherein at least one spring element, which forces the strut into a position unfolded from the table leg, is provided between the table leg and the strut.

4. The table according to claim 1, wherein the support surface is designed to be curved or straight.

5. The table according to claim 1, wherein the folding direction of the strut, a sliding surface or step is connected to the support surface, wherein the strut comes into contact with the sliding surface or the step when the table leg is folded in.

6. The table according to claim 5, wherein the strut comes into sliding contact with the sliding surface for at least some phases when the table leg is folded up.

7. The table according to claim 1, wherein the strut is pivotable about the second joint between a position in which it is folded against the table leg and an unfolded position in which the strut is in self-locking frictional contact, wherein in the unfolded position of the table leg, the support surface extends from a first unfolded angle ($\beta$1) of the strut up to a second unfolded angle ($\beta$3) of the strut.

8. The table according to claim 1, wherein the strut in the unfolded position of the table leg is in self-locking frictional contact with a contact point on the support surface in the unfolded position of the table leg, wherein the angle of the strut to the support surface amounts to $90° \pm 7°$.

9. The table according to claim 1, wherein the strut is pivotable about the second joint between a folded position on the table leg and an unfolded position in which the strut is in self-locking frictional contact, wherein a releasable locking element secures the strut in the unfolded position.

10. The table according to claim 9, wherein the locking element is formed by a pendulum, which is freely pivotable between the released position in which the strut is released and a locked position in which the strut (12) is secured, depending on the alignment of the table.

11. The table according to claim 10, wherein the pendulum in the locked position cooperates with a rib having a blocking effect and is pivotable away from the rib and into the released position.

12. A table (1) having at least one table leg (3, 4) and a table top (2), wherein the at least one table leg (3, 4) is held so that it is pivotable relative to the table top (2) about at least one first joint (5, 6) between an unfolded position and a folded position, wherein a strut (12), which is held on the table leg (3, 4), so that it is pivotable about a second joint (13) at a first end (12*a*), is provided for fixation of the table leg (3, 4), and in the unfolded position of the table leg (3, 4), it is in operative connection with the table top (2) at a second end, which is opposite the first end, and the table leg (3, 4) has a stop (11), which limits the angle between the table leg (3, 4) and the table top (2) in the unfolded position of the table leg (3, 4), such that the strut (12) in the unfolded position of the table leg (3, 4) comes into frictional contact with the second end (12*b*)-on a support surface (14) held on the table top (2), wherein in an unfolded direction of the strut (12), the support surface (14) extends from a first end (14*a*) to a second end (14*b*), and the distance from the first end (14*a*) of the support surface (14) to the second joint (13) in the unfolded position of the table leg (3, 4) is greater than the distance from the second end (14*b*) of the support surface (14) to the second joint (13) in the unfolded position of the table leg (3, 4), so that, in the unfolded position of the table leg (3, 4), the strut (12) is in self-locking frictional contact with the support surface (14) and wherein the strut (12) is pivotable about the second joint (13) between a folded position on the table leg (3, 4) and an unfolded position in which the strut (12) is in self-locking frictional contact, wherein a releasable locking element (17) secures the strut (12) in the unfolded position.

* * * * *